US006405904B1

(12) United States Patent
De Laforcade

(10) Patent No.: US 6,405,904 B1
(45) Date of Patent: Jun. 18, 2002

(54) DISPENSING HEAD INCLUDING AN OUTLET

(75) Inventor: Vincent De Laforcade, Rambouillet (FR)

(73) Assignee: L'Oreal, S.A., Paris (FR)

( * ) Notice: Subject to any disclaimer, the term of this patent is extended or adjusted under 35 U.S.C. 154(b) by 0 days.

(21) Appl. No.: 09/517,178

(22) Filed: Mar. 2, 2000

(30) Foreign Application Priority Data

Mar. 2, 1999 (FR) ..... 99 02563

(51) Int. Cl.[7] ..... B65D 88/54

(52) U.S. Cl. ..... 222/321.3; 222/182; 222/321.6; 222/321.7; 222/321.9; 222/562; 222/380; 222/402.12

(58) Field of Search ..... 222/321.3, 321.7, 222/321.6, 571, 380, 148, 182, 562, 402.12, 321.9

(56) References Cited

U.S. PATENT DOCUMENTS 3,148,805 A * 9/1964 Corsette et al. ..... 222/384
3,263,868 A * 8/1966 Sagarin ..... 222/182
3,422,996 A * 1/1969 Lipman ..... 222/402.11
3,848,778 A * 11/1974 Meshberg ..... 222/402.11
3,851,803 A * 12/1974 Grothoff ..... 222/182
4,050,613 A * 9/1977 Corsette ..... 222/321
4,065,036 A * 12/1977 Kirk, Jr. ..... 222/153
4,324,351 A * 4/1982 Meshberg ..... 222/402.11
4,728,007 A * 3/1988 Samuelson et al. ..... 222/182
5,105,988 A * 4/1992 Knickerbocker ..... 222/148
5,186,368 A * 2/1993 Garcia ..... 222/490
5,215,227 A * 6/1993 Faner ..... 222/175
5,234,132 A * 8/1993 Bachand et al. ..... 222/182
5,255,823 A * 10/1993 Tichy et al. ..... 222/153
5,449,094 A * 9/1995 Behar et al. ..... 222/321.3

* cited by examiner

*Primary Examiner*—William C. Doerrler
*Assistant Examiner*—Frederick Nicolas
(74) *Attorney, Agent, or Firm*—Finnegan, Henderson, Farabow, Garrett & Dunner, LLP

(57) ABSTRACT

A dispensing head for dispensing a product, for example, a cosmetic product, includes a body configured to mount the head on a container containing the product, an actuator that allows a dispensing element on the container to be actuated and an outlet configured to be placed in flow communication with the dispensing element to deliver a dose of product from the outlet. The dispensing head further includes a cover element configured to cover the outlet when the dispensing head is in a storage position. A removable cap is configured to be placed on the body, the cap including a portion that engages with the cover element to retain the cap on the body.

93 Claims, 4 Drawing Sheets

DISPENSING HEAD INCLUDING AN OUTLET

The present invention relates to a dispensing head configured to engage a bottle, a tube, or any other type of packaging on which a dispensing element, such as a hand-actuated pump, is mounted.

A dispensing head of this kind is particularly suited to dispense cosmetic, pharmaceutical, or dermo-pharmaceutical products. Such products often are in the form of a milk, a cream, a paste or a gel. However, a variety of other products also may be dispensed with the inventive dispensing head.

Products to be dispensed using a dispensing head commonly are stored in a bottle or other like container, preferably made of thermoplastic or glass, or other similar material. The dispensing head generally includes: a) a body configured for mounting the head on a container containing a product to be dispensed; b) a push-button that is movable with respect to the body so as to allow a dispensing element surmounting the container to be actuated, the push-button having an outlet orifice in communication with the dispensing element so as to deliver a dose of product through the outlet orifice in response to an actuating command exerted on the push-button when the head is in the dispensing position; and c) a mechanism borne by the body so as to cover the outlet orifice when the dispensing head is in a storage position. A removable cap also may be provided to at least partially cover the head.

There exist several problems with these dispensing assemblies. A first problem is associated with the fact that the covering mechanism covers the orifice in a way that is not always satisfactory since a minimal distance often is left between the covering mechanism and the outlet orifice. The distance separating these two portions causes any of the product remaining near the outlet orifice to dry out and/or oxidize. Such drying out and oxidation may make the device difficult to use after a lengthy period of non-use. For example, the product may clog the outlet orifice. Furthermore, oxidized products often take on a color that is not very attractive. Solutions that are both complex and expensive have been conceived of for solving this problem, yet have never enjoyed success because of their complexity and expensiveness.

Another problem that arises is associated with the mounting of a cap or stopper on such a dispensing head. Typically, there are three types of stoppers: screw-on stoppers, clip-on stoppers, and sliding stoppers. In general, these stoppers are obtained by molding, and generally exhibit undercut portions which, in order to release them from the mold, require either tearing (which is harmful both to the aesthetics and to the robustness of attachment) or the use of a mold of the slide-mold type comprising two parts which move aside before the mold is opened. A mold of this latter kind, however, is more expensive than a simple opening mold. Alternatively, it is possible to provide a mold which unscrews, so as to release the screw thread from the mold.

It also has been proposed for a lid or cap to be retained on a container by means of a system of protuberances formed on the neck of the container, which engage with one or more corresponding members formed on an interior surface of the lid so as to clamp the lid on the container. The container is opened by causing the corresponding member (or members) to pass over the crest of the protuberances by rotating the lid relative to the container in the same direction as the direction of closure.

Thus, one of the objects of the invention is to provide a dispensing head of the aforementioned kind which includes a system for mounting a cap or lid over the dispensing head, that is preferably reliable, economical to produce, and aesthetically attractive. Preferably, the cap or lid should allow the outlet orifice to be covered effectively when the dispensing head is in the storage position, and should do so without adding appreciably to the cost.

It should be understood that the invention could be practiced without performing one or more of the preferred objects and/or advantages described above. Other objects will become apparent from the detailed description which follows.

To achieve these and other advantages, and in accordance with the purposes of the invention, as embodied and broadly described herein, the invention includes a dispensing head for dispensing a product from a container including a dispensing element. The dispensing head includes a body, and an actuator configured to move with respect to the body so as to actuate the dispensing element on the container. The actuator includes an outlet configured to be placed in flow communication with the dispensing element so as to deliver a dose of product through the outlet when the actuator is actuated. A cover element is disposed on the body, the cover element being configured to selectively cover the outlet. A cap is configured to be removably positioned on the body. The cap cooperates with the cover element to retain the cap on the body.

In the preferred embodiment, the cover element performs two functions: first, it covers the outlet of the actuator, and second, it assists in retaining the cap on the body. The functions of such a dispensing head are thus multiplied without increasing its cost in any appreciable way. Preferably, a mechanism disposed on the cap assists in retaining the cap on the body and also improves the leak-tightness of the closure of the outlet by the cover element.

Preferably, the dispensing head may be placed in a storage position or a dispensing position. In a preferred embodiment, a change in position is achieved by rotating the actuator with respect to the body. Such movement may be achieved by a rotation which may be of the order of, for example, a quarter of a turn, or more.

As a preference, a locking mechanism may be provided for preventing the dispensing element from being actuated when the actuator is in the storage position. Such a mechanism may comprise, for example, a lug borne by the actuator. Such a lug may be brought to face a groove made in the body depending on the angular position of the body with respect to the actuator, or vice versa. The angular alignment of the groove and the lug makes it possible for the actuator to be actuated.

As a preference, one of the cover element and a portion of the cap forms at least one ramp extending in a radial direction with respect to the body, while the other of the cover element and the portion of the cap has a profile capable, in response to a rotation of the cap with respect to the body, of coming into engagement with the ramp (or ramps) so as to exert a force which retains the cap onto the body, this force being exerted in at least one radial direction. Thus, the removable cap is retained on the body. The resulting force on the cover element urges it toward the outlet of the actuator, thus appreciably improving the leak-tightness of the contact between the cover element and the outlet.

According to one preferred embodiment, the ramp is provided on a finger forming the cover element. In the storage position, the outlet is sealed by a free end of the finger when the free end is urged in the direction of the outlet by placing the cap in engagement with the ramp provided on the finger. The presence of the ramp between the body and the free end of the finger enables the outlet to be radially offset from the lateral surface of the actuator, thus limiting the risk of product running along the dispensing head and onto the container on which the head is mounted.

The portion of the cap may include at least one protrusion member, such as a fin, formed on the interior surface of a lateral skirt of the cap and extending radially into said cap. Preferably, several fins are distributed uniformly over the interior surface. The presence of a plurality of fins facilitates retention of the cap on the body, by reducing the angular travel through which the cap can be turned with respect to the dispensing head in order to bring one of the fins into engagement with the finger forming the ramp.

According to another aspect of the invention, a dispenser is provided for packaging a product, particularly a cosmetic product. The dispenser is equipped with a dispensing head according to the invention.

The dispenser preferably includes a container and a dispensing element selected from a pump or a valve, or other suitable like dispensing elements, with the pump being the preferred embodiment.

The container may include a bottle, a tube, or a device for the extemporaneous mixing of at least two basic compositions. Typically, a device of this kind for the extemporaneous mixing of two basic compositions is formed of two or more volumes separately containing two or more basic compositions which are not to be mixed until the time of their use. The volumes are preferably separated by sealing means which can be removed at the time the device is first used. Packaging of this kind is particularly suitable for mixtures of the type involving vitamin C or the like, in combination with another composition in the presence of which the vitamin is not stable.

According to another aspect of the invention, a method of storing a product in a container includes providing a dispenser including a container, a dispensing element, and the dispensing head according to the invention. A cap is placed on the body such that the cap cooperates with the cover element to force the cover element toward the outlet to thereby cover the outlet with the cover element. Optionally, this cooperation also retains the cap on the body.

According to another aspect of the present invention, a dispensing head for dispensing product from a container includes a body configured to be associated with a container containing a product to be dispensed. A portion of the dispensing head defines an outlet and an actuator on the body is configured to be actuated to provide flow of the product through the outlet. A cover element also is provided and is configured to engage with a cap configured for removable positioning over at least a portion of the actuator. The engagement of the cover element and the cap causes the closure element to sealingly cover the outlet. In addition, this engagement preferably retains the cap on the body.

Another aspect according to the present invention includes a dispenser comprising a container configured to contain a product to be dispensed, a dispensing element on the container, and a dispensing head. The dispensing head includes a body configured to be associated with the container containing a product to be dispensed. A portion of the dispensing head defines an outlet and an actuator on the body is configured to be actuated to provide flow of the product through the outlet. A cover element also is provided and is configured to engage with a cap configured for removable positioning over at least a portion of the actuator. The engagement of the cover element causes the closure element to sealingly cover the outlet. Preferably, this engagement also retains the cap on the body.

Yet another aspect of the present invention includes a method for storing a product in a dispenser, including positioning a cap over a portion of the dispensing head such that the cap and the cover element are not engaged with each other and rotating the cap in a first direction relative to the portion of the dispensing head to engage the cap and the cover element and thereby cause the cover element to seal the outlet.

In an even further aspect of the invention, a cap is configured to cooperate with the cover element to force the cover element toward the outlet and thereby sealingly cover the outlet with the cover element.

Besides the structural and procedural arrangements set forth above, the invention could include a number of other arrangements, such as those explained hereinafter. It is to be understood that both the foregoing description and the following description are exemplary, and are intended to provide further explanation of the invention as claimed.

The accompanying drawings are included to provide a further understanding of the invention and are incorporated in and constitute a part of this specification. The drawings illustrate embodiments of the invention and, together with the description, serve to explain the principles of the invention. In the drawings, FIG. 1 is an exploded view of a dispenser equipped with a dispensing head according to a preferred embodiment of the invention;

Reference will now be made in detail to the present preferred embodiments of the invention, examples of which are illustrated in the accompanying drawings. Wherever possible, the same reference numbers are used in the drawings and the description to refer to the same or like parts.

Figure 1:
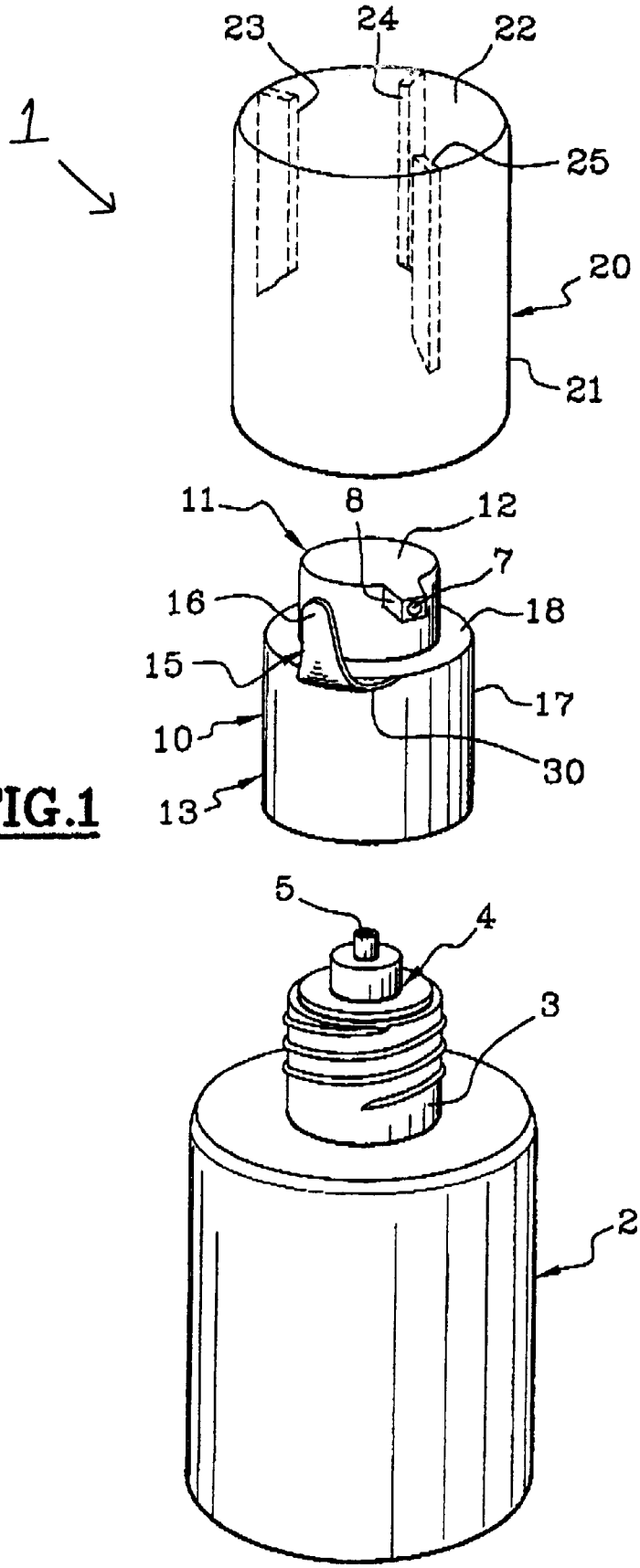

As depicted in FIG. 1, a dispenser 1 includes a dispensing head 10 and a container 2, preferably made of glass or other suitable material, one end of which terminates in a neck 3. A free edge of neck 3 defines an opening in which a dispensing element 4 is mounted. In a preferred embodiment, the dispensing element 4 is a pump having a pump stem 5. Pump stem 5 is configured to provide mounting by force-fitting or other similar joining methods of an actuator 11 provided on dispensing head 10. Preferably, actuator 11 is an axially moveable push-button having an internal, axial tubular member (not shown) in flow communication with an outlet orifice 7. Outlet orifice 7 preferably is formed at the end of a protuberance 8 disposed on push-button 11. Push-button 11 includes a surface 12 configured for pressing in order to actuate pump 4. Although the preferred embodiment preferably includes both the axially movable push-button and pump to dispense a dose of product from the container, it is contemplated that actuators other than a push-button and dispensing elements other than a pump are still within the scope of the invention. For example, the dispensing element could be a valve when contents of the container are pressurized.

The push-button 11 is mounted so that the push-button 11 can move axially and, at least partially rotate, with respect to a body 13 of the dispensing head 10. For example, the body 13 is preferably configured to engage container 2 by snap-fastening or screw-fastening, or other similar fastening method. Alternatively, however, body 13 and container 2 could be formed as an integral, single-piece arrangement (not shown). Dispensing head 10 may be obtained by molding one or more thermoplastics preferably selected from, for example, polypropylenes and polyethylene, or other similar materials. Push-button 11 and body 13 preferably are molded as a single piece, formed of two parts joined together by self-breaking bridges of material which are then broken, preferably at the time of fitting or at the time of first use. However, other molding or manufacturing techniques may be employed to make push-button 11 and are considered to be within the scope of the invention. In the embodiment illustrated, body 13 is screwed onto neck 3 of container 2 and has an internal portion (not depicted) capable of holding pump 4 in position inside neck 3 of bottle 2. Alternatively, pump 4 could be forcibly held inside neck 3 of the bottle 2, or could be bonded thereto. In another embodiment (not shown), the body 13 could be an integral part of container 2.

Body 13 bears a cover element 15, in the form of a finger, facing away from container 2. Finger 15 has an approximately planar free-end portion 16 configured, as will be explained in detail later, to be aligned with and to sealingly engage outlet orifice 7 of push-button 11. In this position, referred to-as the storage position, the risk of the drying out or oxidizing of any product which may remain near the outlet orifice 7 after use is reduced. At an end opposite to free end 16, finger 15 is attached to body 13 at a region where a lateral skirt 17 of body 13 and a transverse collar 18 of body 13 meet. Finger 15 may be formed by molding with body 13, or by other suitable methods. Between the collar 18 and free end portion 16, the finger 15 has a curved portion 30 capable, as is more clearly apparent from FIGS. 3B and 3C, of forming a protrusion, in the form of a ramp, for example, progressing in a radial direction away from body 13.

A cap 20 including a lateral skirt 21 is provided to cover at least a portion of the body 13 and push-button 11. Lateral skirt 21 includes an open end and an end closed by an end wall 22. Arranged radially on the interior surface of lateral skirt 21 are protrusion members, for example, in the form of three fins 23–25 spaced 120° apart and configured, in response to a rotation of cap 20 with respect to body 13, to engage with the ramp 30 of finger 15 so as to retain cap 20 radially onto container 2. The presence of several fins spaced uniformly makes it possible to reduce the angle of rotation needed to retain cap 20 onto body 13. Although three fins are disclosed with respect to the preferred embodiment of the invention, any number of fins may be used depending on the degree of rotation desired before cap 20 will be retained into place. As will be seen in detail later, the retaining of cap 20 onto body 13 contributes to urging free end 16 of finger 15 toward outlet orifice 7 of push-button 11 so as to achieve at least a substantially leaktight contact between finger 15 and orifice 7. Preferably, the finger is formed of an elastic, thermoplastic that permits the movement of the free end 16 of finger 15 closer to outlet orifice 7.

The radial distance of ramp 30 is advantageously chosen so that, under normal conditions of cap retaining, fins 23–25 do not pass over its crest. Thus, removal of cap 20 entails rotating cap 20 with respect to container 2 in a direction opposite to the rotational direction for retaining cap 20 into place.

Figure 2A:
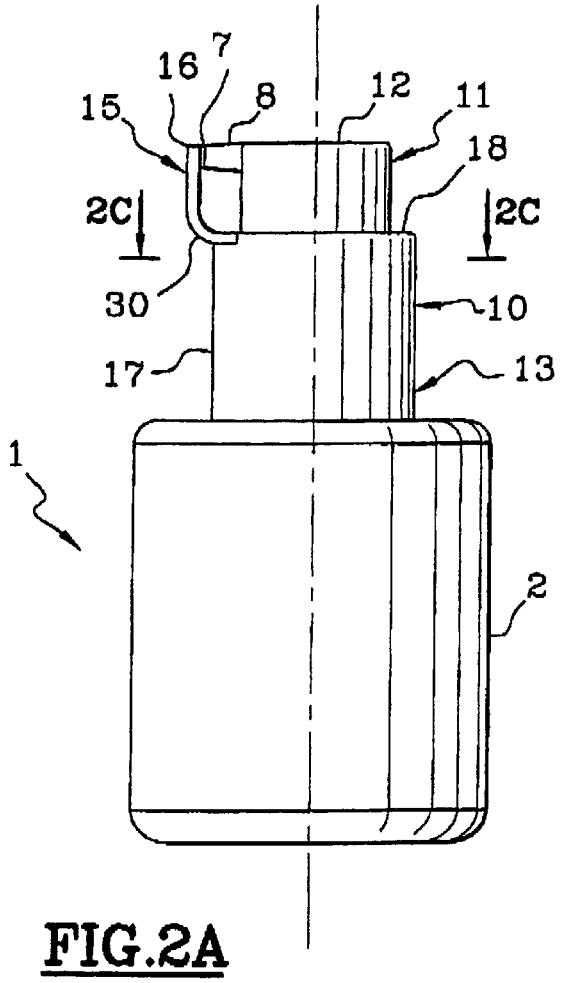
FIG. 2A is a side view of the dispenser of FIG. 1 with the dispensing head in a storage position and with the cap removed.
Figure 2B:
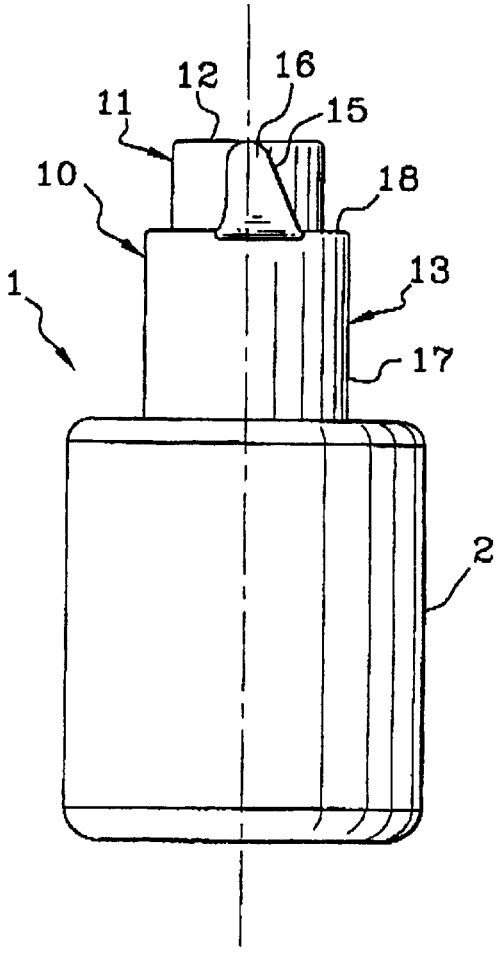
FIG. 2B is a view similar to FIG. 2A.
Figure 2C:
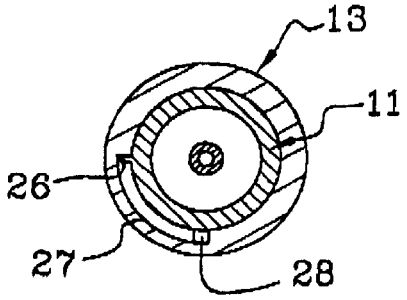
FIG. 2C is a cross-sectional view taken along line 2C—2C of FIG. 2A.

FIG. 2A shows a side view of dispensing head 10 in the storage position. FIG. 2B shows a front view of the dispensing head 10 in the storage position. In the storage position, finger 15 is disposed opposite outlet orifice 7 of push-button 11. In this position, sealing of the orifice 7 is limited particularly because of the radial clearance provided between push-button 11 and body 13 to permit moving push-button 11 between the dispensing position (FIGS. 2D, 2E) and the storage position (FIGS. 2A, 2B, 2C). This clearance preferably may be of the order of about 1 mm or more. In the position of FIGS. 2A and 2B, as is apparent from the cross-section view of FIG. 2C, a lug 26 borne by push-button 11 is in abutment against a first end of a recess 27 formed in body 13 and extending over an angular sector of about 90°. When push-button 11 rotates with respect to body 13, lug 26 moves in recess 27. In the position of FIGS. 2A–2C, lug 26 is angularly offset with respect to a groove 28 formed on body 13 at a second end of recess 27 opposite to the first end and extending at right angles to the plane containing recess 27. Thus, push-button 11 cannot be displaced axially in order to actuate pump 4, which prevents accidentally dispensing a dose of product when the dispensing head 10 is in the storage position.

Figure 2D:
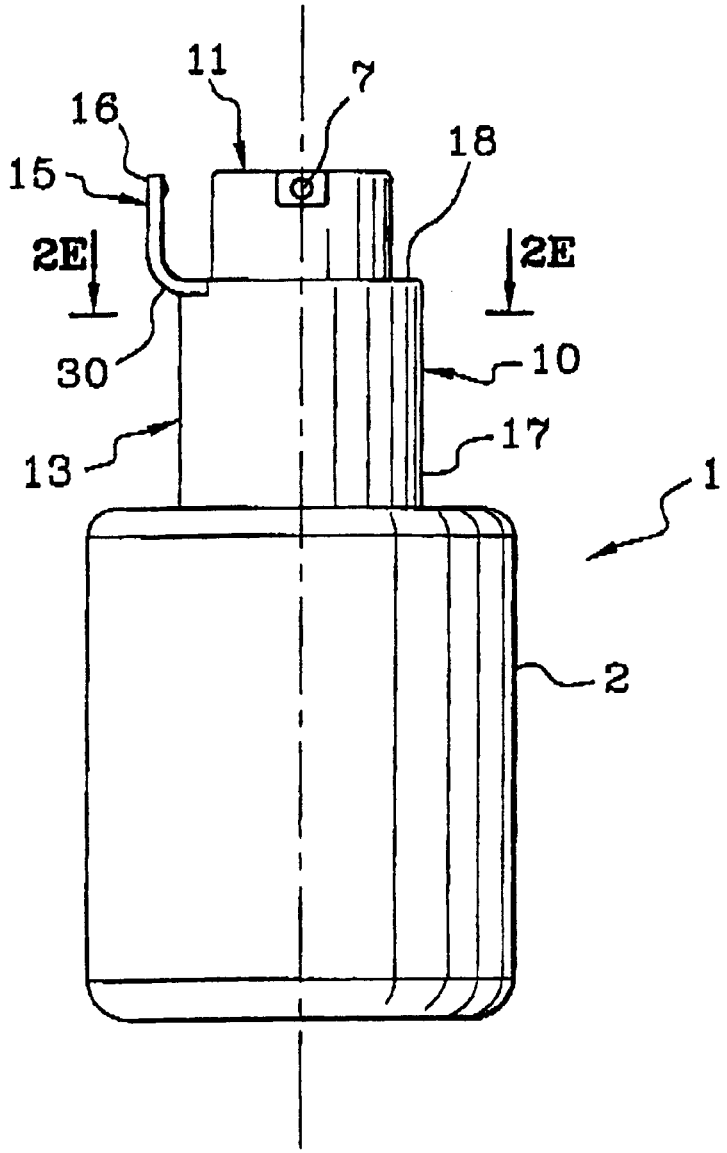
FIG. 2D is a front view of the dispenser of FIG. 1 showing the dispensing head in a dispensing position with the cap removed.
Figure 2E:
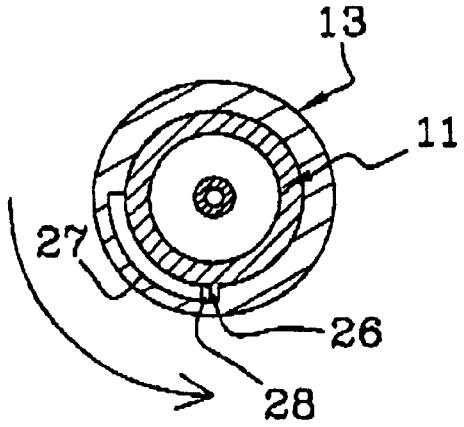
FIG. 2E is a cross-section view taken along line 2E—2E of FIG. 2D.

In the dispensing position illustrated in FIGS. 2D and 2E (which also correspond to the position of FIG. 1), outlet orifice 7 is offset angularly with respect to finger 15. As is apparent from FIG. 2E, lug 26 is aligned with groove 28 which allows for passage of the lug 26 through the groove 28. Thus, in this position, push-button 11 can be depressed axially so as to actuate pump 4 and dispense a dose of product through outlet orifice 7 which, in this position, is not covered by finger 15.

Figure 3A:
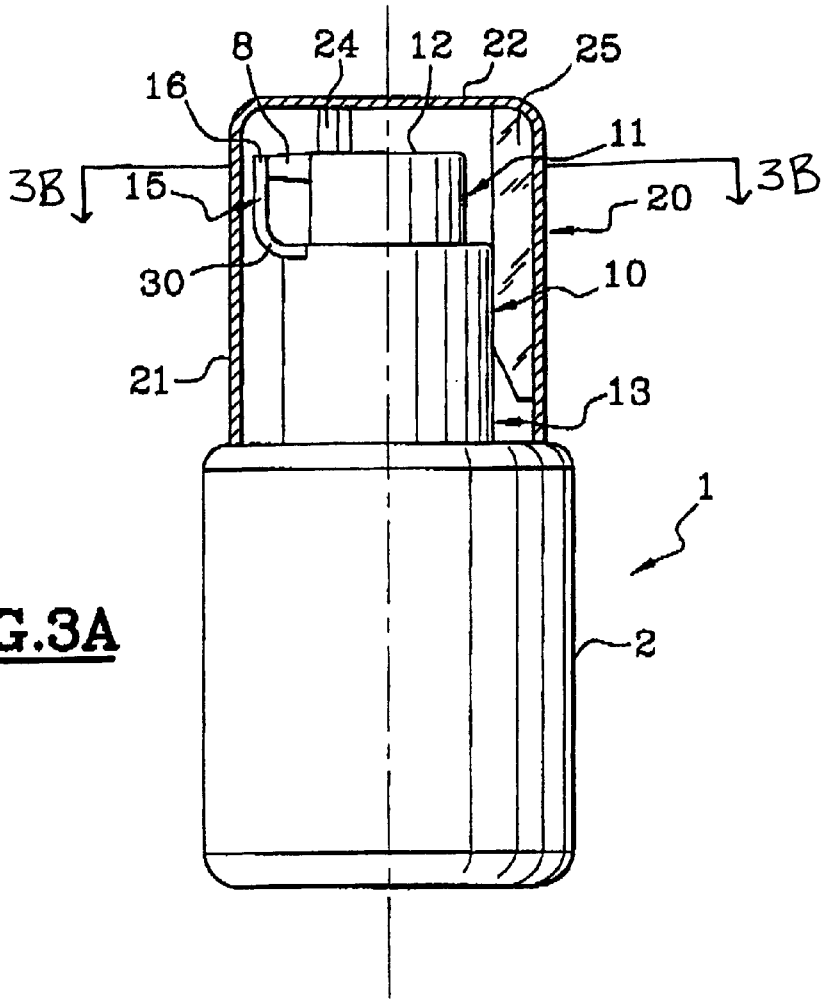
FIG. 3A is a side view of the dispenser of FIG. 1 with the cap shown in cross-section in a locked position.
Figure 3C:
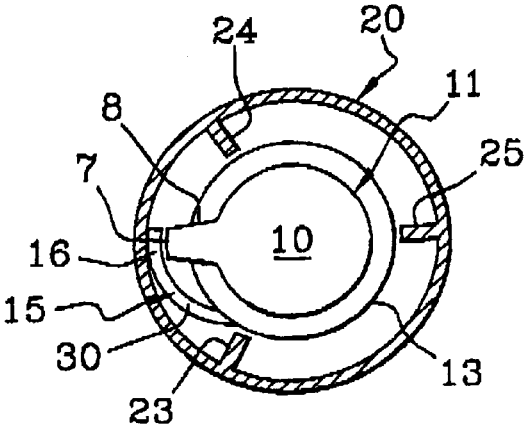
FIG. 3C is a view similar to FIG. 3B showing the cap in an unlocked position.
Figure 3B:
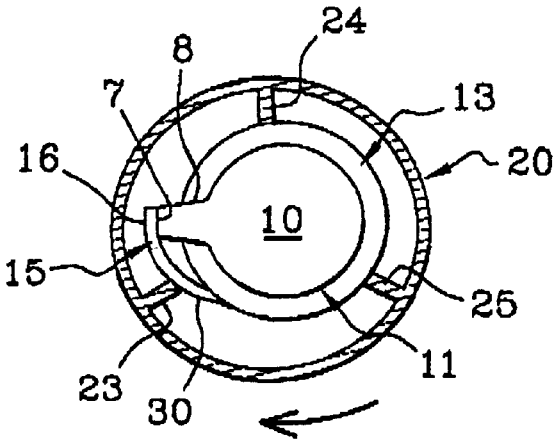
FIG. 3B is a cross-section view taken along line 3B—3B of FIG. 3A.

To mount cap 20, the user places the cap on the dispensing head as depicted in FIG. 3A. Initially, each of the fins 23, 24, and 25 is out of engagement with ramp 30 formed by finger 15 (FIG. 3C). In this position, free end 16 of finger 15 is not in leaktight contact with outlet orifice 7. Next, the user turns cap 20 in the way shown in FIG. 3B. After a rotation of at most about 120°, one of fins 23, 24, or 25 is brought into engagement with ramp 30 formed by finger 15. Such engagement retains cap 20 on body 13 due to the elastic properties of the finger 15 and also brings free end 16 of finger 15 against outlet orifice 7 so as to cover outlet orifice 7 in a sealed manner. The two fins not engaging with finger 15 are urged toward body 13 to assist in retaining cap 20 onto dispensing head 10.

Removing cap 20 from dispensing head 10 is achieved by first rotating it with respect to container 2 in a direction opposite to the direction it was rotated to engage cap 20 with dispensing head 10 and retain the cap on container 2 and dispensing head 10. When fin 23, for example, ceases to engage with ramp 30, finger 15 returns, through an elastic return effect, to the position of FIG. 3C in which free end 16 is not in leaktight contact with outlet orifice 7. Cap 20 can therefore be removed and push-button 11 turned with respect to body 13 so as to move dispensing head 10 from the storage position into the dispensing position.

Preferably, the container 2 contains a cosmetic, pharmaceutical, or dermo-pharmaceutical product. In its broadest aspects, the present invention could be used to store and dispense many other types of flowable substances.

It will be apparent to those skilled in the art that various modifications and variations can be made to the structure and methodology of the present invention without departing from the scope or spirit of the invention. Thus, it should be understood that the invention is not limited to the examples discussed in the specification. Rather, the present invention is intended to cover modifications and variations of this invention, provided they fall within the scope of the following claims and their equivalents.

What is claimed is:

1. A dispensing head for dispensing a product from a container including a dispensing element, comprising:

a body;

an actuator configured to move with respect to the body so as to actuate the dispensing element on the container, said actuator including an outlet configured to be placed in flow communication with the dispensing element so as to deliver a dose of said product through said outlet when the actuator is actuated;

a cover element on the body, the cover element being configured to selectively cover the outlet; and a hollow cap configured to be removably positioned on the body, said hollow cap being configured to cooperate with the cover element to retain the cap on the body, wherein one of the cover element and a portion of the cap forms at least one protrusion extending in a radial direction with respect to the body, and the other of the cover element and the portion of the cap has a profile configured, in response to selective rotation of the cap with respect to the body, to engage said protrusion so as to retain the cap on the body.

2. The dispensing head according to claim 1, wherein the actuator is rotatable on the body between a storage position wherein the outlet in the actuator is aligned with the cover element and a dispensing position wherein the outlet in the actuator is out of alignment with the cover element.

3. The dispensing head according to claim 1, further comprising a locking mechanism configured to selectively prevent the actuator from being actuated.

4. The dispensing head of claim 1, wherein the cover element is a finger and wherein said protrusion is a ramp on the finger.

5. The dispensing head according to claim 1, wherein the body is configured to be mounted on the container.

6. The dispensing head according to claim 1, wherein the actuator is a push-button movable axially and rotatably on the body.

7. A dispenser comprising:

a container including a dispensing element; and the dispensing head of claim 1 on the container.

8. The dispensing head according to claim 3, wherein the actuator is a push-button movable axially on the body, and wherein the locking mechanism is configured to selectively limit axial movement of the push-button.

9. The dispensing head according to claim 4, wherein engagement of the portion of the cap with the ramp elastically urges the finger toward the outlet to seal the outlet.

10. The dispensing head according to claim 4, wherein said portion of the cap includes at least one fin formed on an interior surface of a lateral skirt of the cap and extending radially inward.

11. The dispensing head according to claim 5, wherein the body includes an internal thread configured to engage an external thread on the container.

12. The dispenser according to claim 7, wherein the dispensing element is one of a Pump and a valve.

13. The dispenser according to claim 7,wherein the container is one of a bottle, a tube, and a device configured to permit mixing of at least two compositions.

14. The dispenser of claim 7, wherein a cosmetic product is contained in the container.

15. The dispenser of claim 7, wherein the body of the dispensing head is mounted on the container.

16. A method of storing a product in a container, comprising:

providing the dispenser of claim 7;

placing the capon the body such that the cap cooperates with the cover element to force the cover element toward the outlet to thereby cover the outlet with the cover element.

17. The dispensing head according to claim 10, wherein a plurality of fins are distributed uniformly over said interior surface of said cap.

18. A dispensing head for dispensing a product from a container, comprising:

a body configured to be associated with a container containing a product to be dispensed;

a portion defining an outlet;

an actuator on the body configured to be actuated to provide flow of the product through the outlet; and a finger-shaped cover element having a fixed end provided on the body and a free end, wherein the fixed end of the cover element includes a protruding portion extending in a radial direction away from the body, the protruding portion comprising a ramp configured to engage with a protrusion member disposed on an inner surface of a cap configured for removable positioning over at least a portion of the actuator, wherein the engagement of the cover element and the cap causes the cover element to sealingly cover the outlet.

19. The dispensing head of claim 18, wherein the engagement of the cover element and the cap retains the cap over the portion of the actuator.

20. The dispensing head of claim 18, wherein the actuator includes a push-button configured to move axially relative to the body.

21. The dispensing head of claim 18, wherein the free end is configured to sealingly cover the outlet when the cover element is engaged with the cap.

22. The dispensing head of claim 18, further comprising the cap, wherein the cap is rotatable with respect to the body between an engaged position in which the ramp engages the protrusion member and a disengaged position in which the ramp and the protrusion member are not engaged.

23. A method of storing a product in a container, comprising:

providing a dispenser including a container containing a product and the dispensing head of claim 18 on the container; and positioning a cap on the body such that the cap engages with the cover element to force the cover element to sealingly cover the outlet.

24. A dispenser comprising:

a container configured to contain a product to be dispensed;

a dispensing element on the container; and the dispensing head of claim 19 on the container.

25. The dispensing head of claim 20, wherein the actuator is configured to actuate one of a pump and a valve disposed on the container when the body is provided on the container.

26. The dispensing head of claim 20, wherein the outlet is an orifice defined by a portion of the push-button.

27. The dispensing head of claim 21, wherein the free end is configured to be urged toward the outlet when the cover element is engaged with the cap.

28. The dispensing head of claim 22, wherein the cap includes more than one protrusion member disposed on the inner surface such that the engagement of one of the protrusion members with the ramp causes the other protrusion member to engage with an outer surface of the body.

29. The dispensing head of claim 22, wherein the cap is configured to rotate in opposite directions between the engaged and disengaged positions.

30. The method of claim 23, wherein engaging the cap and the cover element retains the cap on the body.

31. The dispensing head of claim 26, wherein the push-button is configured to rotate relative to the body between a storage position and a dispensing position.

32. The dispensing head of claim 31, wherein the outlet orifice is aligned with a portion of the cover element when the push-button is in the storage position.

33. The dispensing head of claim 32, further comprising a locking mechanism configured to prevent axial movement of the push-button when the push-button is in the storage position.

34. A method for storing a product in a dispenser, comprising:

providing a dispenser including a dispensing head provided on a container containing the product, the dispensing head including an outlet and a cover element, and a removable cap;

positioning the cap over at least a portion of the dispensing head such that the cap and the cover element are not engaged with each other; and rotating the cap in a first direction relative to said portion of the dispensing head to engage the cap and the cover element and thereby cause the cover element to seal the outlet.

35. The method of claim 34, wherein the rotating of the cap retains the cap on the container.

36. The method of claim 34, wherein the outlet is provided on a section of the dispensing head movable between a storage position and a dispensing position and prior to positioning the cap over the portion of the dispensing head, the section is moved to the storage position.

37. The method of claim 34, wherein said rotating of the cap urges a portion of the cover element toward,the outlet to thereby seal the outlet.

38. The method of claim 34, further comprising providing an actuator, wherein actuating the actuator causes product to be dispensed from the outlet when the actuator is in a dispensing position.

39. The method of claim 36, wherein moving the section to the storage position includes aligning the cover element and the outlet.

40. The method of claim 38, wherein said actuator is a push-button disposed on the dispensing head and said actuating occurs by depressing the push-button relative to the container.

41. The method of claim 40, wherein the outlet is an orifice defined by the push-button.

42. The method of claim 40, further comprising moving the push-button to a storage position to prevent depression of the push-button.

43. A dispensing head for dispensing a product from a container including a dispensing element, comprising:

a body;

an actuator configured to move with respect to the body so as to actuate the dispensing element on the container, said actuator including an outlet configured to be placed in flow communication with the dispensing element so as to delivery a dose of said product through said outlet when the actuator is actuated;

a cover element on the body, the cover element being configured to selectively cover the outlet; and a cap having a top portion and at least one side wall extending substantially vertically from the top portion, the cap being configured to be removably positioned on the body, and the cap being configured to cooperate with the cover element to retain the cap on the body, wherein one of the cover element and a portion of the cap forms at least one protrusion extending in a radial direction with respect to the body, and the other of the cover element and the portion of the cap has a profile configured, in response to selective rotation of the cap with respect to the body, to engage said protrusion so as to retain the cap on the body.

44. The dispensing head according to claim 43, wherein the actuator is rotatable on the body between a storage position wherein the outlet in the actuator is aligned with the cover element and a dispensing position wherein the outlet in the actuator is out of alignment with the cover element.

45. The dispensing head according to claim 43, further comprising a locking mechanism configured to selectively prevent the actuator from being actuated.

46. The dispensing head according to claim 43, wherein the cover element is a finger and wherein said protrusion is a ramp on the finger.

47. The dispensing head according to claim 43, wherein the body is configured to be mounted on the container.

48. The dispensing head according to claim 43, wherein the actuator is a push-button movable axially and rotatably on the body.

49. A dispenser comprising:

a container including a dispensing element; and the dispensing head of claim 43 on the container.

50. The dispensing head according to claim 45, wherein the actuator is a push-button movable axially on the body, and wherein the locking mechanism is configured to selectively limit axial movement of the push-button.

51. The dispensing head according to claim 46, wherein engagement of the portion of the cap with the ramp elastically urges the finger toward the outlet to seal the outlet.

52. The dispensing head according to claim 46, wherein said portion of the cap includes at least one fin formed on an interior surface of a lateral skirt of the cap and extending radially inward.

53. The dispensing head according to claim 47, wherein the body includes an internal thread configured to engage an external thread on the container.

54. The dispenser according to claim 49, wherein the dispensing element is one of a pump and a valve.

55. The dispenser according to claim 49, wherein the container is one of a bottle, a tube, and a device configured to permit mixing of at least two compositions.

56. The dispenser of claim 49, wherein a cosmetic product is contained in the container.

57. The dispenser of claim 49, wherein the body of the dispensing head is mounted on the container.

58. A method of storing a product in a container, comprising: providing the dispenser of claim 49; and placing the cap on the body such that the cap cooperates with the cover element to force the cover element toward the outlet to thereby cover the outlet with the cover element.

59. The dispensing head according to claim 52, wherein a plurality of fins are distributed uniformly over said interior surface of said cap.

60. A dispensing head for dispensing a product from a container including a dispensing element, comprising:

a body;

an actuator configured. to move with respect to the body so as to actuate the dispensing element on the container, said actuator including an outlet configured to be placed in flow communication with the dispensing element so as to deliver a dose of said product through said outlet when the actuator is actuated;

a cover element on the body, the cover element being configured to selectively cover the outlet; and a cap configured to be removably positioned on the body, said cap being configured to cooperate with the cover element to retain the cap on the body, wherein at least a portion of the cap is configured to cover the outlet when the cap is positioned on the body, and wherein one of the cover element and a portion of the cap forms at least one protrusion extending in a radial direction with respect to the body, and the other of the cover element and the portion of the cap has a profiled configured, in response to selective rotation of the cap with respect to the body, to engage said protrusion so as to retain the cap on the body.

61. The dispensing head according to claim 60, wherein the actuator is rotatable on the body between a storage position wherein the outlet in the actuator is aligned with the cover element and a dispensing position wherein the outlet in the actuator is out of alignment with the cover element.

62. The dispensing head according to claim 60, further comprising a locking mechanism configured to selectively prevent the actuator from being actuated.

63. The dispensing head according to claim 60, wherein the cover element is a finger and wherein the protrusion is a ramp on the finger.

64. The dispensing head according to claim 60, wherein the body is configured to be mounted on the container.

65. The dispensing head according to claim 60, wherein the actuator is a push-button movable axially and rotatably on the body.

66. A dispenser comprising:

a container including a dispensing element; and the dispensing head of claim 60 on the container.

67. The dispensing head according to claim 62, wherein the actuator is a push-button movable axially on the body, and wherein the locking mechanism is configured to selectively limit axial movement of the push-button.

68. The dispensing head according to claim 63, wherein engagement of the portion of the cap with the ramp elastically urges the finger toward the outlet to seal the outlet.

69. The dispensing head according to claim 63, wherein said portion of the cap includes at least one fin formed on an interior surface of a lateral skirt of the cap and extending radially inward.

70. The dispensing head according to claim 64, wherein the body includes an internal thread configured to engage an external thread on the container.

71. The dispenser according to claim 66, wherein the dispensing element is one of a pump and a valve.

72. The dispenser according to claim 66, wherein the container is one of a bottle, a tube, and a device configured to permit mixing of at least two compositions.

73. The dispenser of claim 66, wherein a cosmetic product is contained in the container.

74. The dispenser of claim 66, wherein the body of the dispensing head is mounted on the container.

75. A method of storing a product in a container, comprising: providing the dispenser of claim 66; and placing the cap on the body such that the cap cooperates with the cover element to force the cover element toward the outlet to thereby cover the outlet with the cover element.

76. The dispensing head according to claim 69, wherein a plurality of fins are distributed uniformly over said interior surface of said cap.

77. A dispensing head for dispensing a product from a container including a dispensing element, comprising:

a body;

an actuator configured to move with respect to the body so as to actuate the dispensing element on the container, said actuator including an outlet configured to be placed in flow communication with the dispensing element so as to deliver a dose of said product through said outlet when the actuator is actuated;

a cover element on the body, the cover element being configured to selectively cover the outlet; and a cap configured to be removably positioned on the body, the cap being configured to be moved relative to the cover element from a first position to a second position to removably retain the cap on the body, wherein one of the cover element and a portion of the cap forms at least one protrusion extending in a radial direction with respect to the body, and the other of the cover element and the portion of the cap has a profile configured, in response to selective rotation of the cap with respect to the body, to engage said protrusion so as to retain the cap on the body.

78. The dispensing head according to claim 77, wherein the actuator is rotatable on the body between a storage position wherein the outlet in the actuator is aligned with the cover element and a dispensing position wherein the outlet in the actuator is out of alignment with the cover element.

79. The dispensing head according to claim 77, further comprising a locking mechanism configured to selectively prevent the actuator from being actuated.

80. The dispensing head according to claim 77, wherein the cover element is a finger and wherein said protrusion is a ramp on the finger.

81. The dispensing head according to claim 77, wherein the body is configured to be mounted on the container.

82. The dispensing head according to claim 77, wherein the actuator is a push-button movable axially and rotatably on the body.

83. A dispenser comprising:

a container including a dispensing element; and the dispensing head of claim 77 on the container.

84. The dispensing head according to claim 77, wherein the actuator is a push-button movable axially on the body, and wherein the locking mechanism is configured to selectively limit axial movement of the push-button.

85. The dispensing head according to claim 80, wherein engagement of the portion of the cap with the ramp elastically urges the finger toward the outlet to seal the outlet.

86. The dispensing head according to claim 80, wherein said portion of the cap includes at least one fin formed on an interior surface of a lateral skirt of the cap and extending radially inward.

87. The dispensing head according to claim 81, wherein the body includes an internal thread configured to engage an external thread on the container.

88. The dispenser according to claim 83, wherein the dispensing element is one of a pump and a valve.

89. The dispenser according to claim 83, wherein the container is one of a bottle, a tube, and a device configured to permit mixing of at least two compositions.

90. The dispenser of claim 83, wherein a cosmetic product is contained in the container.

91. The dispenser of claim 83, wherein the body of the dispensing head is mounted on the container.

92. A method of storing a product in a container, comprising: providing the dispenser of claim 83; and placing the cap on the body such that the cap cooperates with the cover element to force the cover element toward the outlet to thereby cover the outlet with the cover element.

93. The dispensing head according to claim 86, wherein a plurality of fins are distributed uniformly over said interior surface of said cap.

* * * * *

UNITED STATES PATENT AND TRADEMARK OFFICE

CERTIFICATE OF CORRECTION

PATENT NO. : 6,405,904 B1
DATED : June 18, 2002
INVENTOR(S) : Vincent De Laforcade It is certified that error appears in the above-identified patent and that said Letters Patent is hereby corrected as shown below:

Column 7,
Line 55, replace “Pump” with -- pump --;
Line 66, replace “capon” with -- cap on --;

Column 9,
Line 31, delete “,” after “toward”; and

Column 10,
Line 55, delete “.” after “configured”.

Signed and Sealed this

Twenty-seventh Day of August, 2002

*Attest:*

*Attesting Officer*

JAMES E. ROGAN
*Director of the United States Patent and Trademark Office*